US008245659B2

(12) United States Patent
Besenzoni

(10) Patent No.: US 8,245,659 B2
(45) Date of Patent: Aug. 21, 2012

(54) MECHANICAL MEMBER FOR FAVOURING THE MOVEMENT OF MEANS OF TRANSPORT

(76) Inventor: Giorgio Besenzoni, Paratico (IT)

( * ) Notice: Subject to any disclaimer, the term of this patent is extended or adjusted under 35 U.S.C. 154(b) by 0 days.

(21) Appl. No.: 12/077,936

(22) Filed: Mar. 24, 2008

(65) Prior Publication Data

US 2008/0276854 A1 Nov. 13, 2008

(30) Foreign Application Priority Data

May 8, 2007 (IT) ..... VI2007A0132

(51) Int. Cl.
*B63B 59/02* (2006.01)

(52) U.S. Cl. ..... 114/219

(58) Field of Classification Search ..... 114/219, 114/220

See application file for complete search history.

(56) References Cited

U.S. PATENT DOCUMENTS 3,528,383 A * 9/1970 Fetters ..... 114/220
6,196,150 B1 * 3/2001 Fondacaro ..... 114/219
6,332,421 B1 * 12/2001 Leonard et al. ..... 114/220
6,494,157 B1 * 12/2002 Leemon ..... 114/219

* cited by examiner

*Primary Examiner* — Daniel Venne

(74) *Attorney, Agent, or Firm* — Hedman & Costigan, P.C.; Kathleen A. Costigan

(57) ABSTRACT

Mechanical member (1; 100; 200) for a means of transport such as a boat—where said mechanical member has a support shaft (2; 101; 201), provided with a main axis (Y) that is mountable on the means of transport. Sliding bodies (3; 108; 202) are connected to the support shaft (2; 101; 201) through a union or connector (4; 203), which includes shaped disks (5;6;102;103;104;105;) and radial shock absorbers (17) mounted at the end of the shaped disks so that the sliding bodies (3, 108, 202) come into contact with any adjacent structures to direct the movement of the means of transport and prevent damage to adjacent structures.

34 Claims, 9 Drawing Sheets

Sez. A-A

Sez B-B

Sez. A-A

Sez. A-A

Sez. A-A

Sez. A-A

Sez. A-A

Sez. A-A

MECHANICAL MEMBER FOR FAVOURING THE MOVEMENT OF MEANS OF TRANSPORT

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1. Field of the Invention

The present invention relates to a mechanical member for favouring the movement of means of transport, suitable especially but not exclusively for facilitating the berthing or the mooring of boats.

2. Description of Related Art

It is well-known, the manuverings with which certain means of transport, such as boats, hulls and the like are placed in the stop position, at the side of a generic support structure or other means of the same or different type, are very critical and difficult.

Considering, for example, the case of a boat which must dock at the wharf or at the pier of a harbor or which, likewise, must moor close to other boats already moored, in particularly in a predetermined space between two of them.

The difficulty is primarily determined by two reasons: the unstable nature of the surface on which the means of transport move, such as the water, and the motion direction with which these means of transport are moved.

Furthermore, difficulties in maneuvering a means of transport will depend on the natural impediments and on the ability of the driver.

Therefore, it happens that, despite the extreme care taken on maneuverings by the drivers, in their movement of the means of transport inevitably and accidentally hit objects, with the obvious problems that this implies for the structural integrity of the means of transport and the objects that are hit.

Furthermore, in order to limit the damages that occur when means of transport collide, the drivers of the means of transport carry slowly the maneuver the means of transport and may be forced to repeat the maneuvers several times, which results in lengthening the time required for their completion.

Therefore, there is a need for careful maneuvering of the means of transport in the berthing of the means of transport in an area where there are many means of transport and any other structure or body is located close to the means of transport during the manuverings.

Various types of equipment are now available on the market, including inflatable fenders or fenders containing spongy or rubbery material, used to eliminate or limit the harmful effects which are caused by collisions between means of transport.

However, these elements, which sometimes project from the side of the boat or are sometimes fixed directly to the pier or wharf, only offer the opportunity to protect the means of transport from collisions in static conditions, namely when the means of transport are moored.

Therefore, they are not helpful in situations where the boat or the ship is moving.

After all, the main drawback in the prior art is linked to the absence of adequate protection against accidental collisions which can happen when one of the means of transport is moving.

A last but not least drawback is due to the fact that, in many cases, the accidental collisions cause huge damage both to the means of transport which cause the collision and to the other means of transport or facilities which suffer them, with the obvious disadvantages arising in terms of repair and/or replacement costs.

In the case of boats, the adverse effects of the casual collisions are magnified by the instability of the surface on which they move, which reduces their maneuverability. In addition, the value of the material of the hull which suffers the collisions, which are often fiber glass reinforced is also adversely affected.

The present invention aims to overcome the just cited drawbacks of the state of the art.

In particular, the main aim of the invention is to provide a mechanical member for protecting a means of transport which and any other structures from damage due to the accidental collisions caused by moving means of transport.

In other words, the invention provides an appropriate protection to means of transport or other structures from uncontrolled collisions caused by a means of transport. An example is a boat that is being moored or berthed at a pier or wharf of a port.

It is an object of the present invention to safeguard to a greater extent, compared to the prior art, the structural integrity of means of transport or other structures which come into contact with the means of transport when the means of transport are in motion.

Another object of the invention is to limit the need for repairs and/or the replacement of structural parts damaged by accidental collisions caused by moving means of transport.

A further object of the invention is to provide a mechanical member which, in comparison to the state of the art, simplifies, the maneuverings performed by the driver of a means of transport especially in the presence of other similar means or in the vicinity of any support structure.

BRIEF SUMMARY OF THE INVENTION

The aforesaid objects are achieved through a mechanical member for facilitating the movement of means of transport such as a boat, where said mechanical member (1; 100; 200) for facilitating the movement of a boat, is a mechanical member having a support shaft (2; 101; 201) provided with a main axis (Y), said support shaft (2;101; 201) being adapted to be disposed protruding from said boat; at least one sliding body (3; 108; 202), connected to said support shaft (2; 101; 201) through a union (4; 203) and sized to protect boats or structures from damage due to contact with a boat when said boat is moved.

Advantageously, the mechanical member of the invention is arranged on the side of a means of transport, for example on the side of a boat or the like, while the means of transport itself is still on the move.

If the means of transport is a boat, the mechanical member of the invention is useful yet during docking, mooring or even berthing at the port, while the boat is still moving.

The mechanical member thus protects the means of transport to which it is affixed, as well as other means of transport or structures which come into contact with the means of transport, from the harmful effects resulting from the inevitable accidental collisions which occur when boats are moved.

The function of the mechanical member of the invention is to mitigate to a great extent the negative effects of the collisions between the means of transport and other structures, avoiding sudden and sharp impacts between the member itself and the bodies with which it comes into contact by facilitating their mutual sliding.

Still advantageously, the invention simplifies with respect to the prior art the work of the driver of a means of transport during when a means of transport is moved during critical conditions, when structures are in proximity to the moving means of transport.

Indeed, in such circumstances, the invention allows the driver to perform the maneuverings faster than at present, without prejudicing the structural integrity of the means of transport or other bodies close to it.

Equally advantageously, the invention avoids the negative effects, in some cases even ruinous, arising from fortuitous collisions caused by a means of transport in motion.

In an advantageous manner, this helps to reduce, in comparison with the prior art the costs due to repair, replacement and, more generally, maintenance of the means of transport.

BRIEF DESCRIPTION OF THE DRAWINGS

The aforesaid aims and advantages will be more evident from the description of preferred embodiments of the invention, given by way of non-limiting examples with respect to the attached drawings where.

Figure 1:
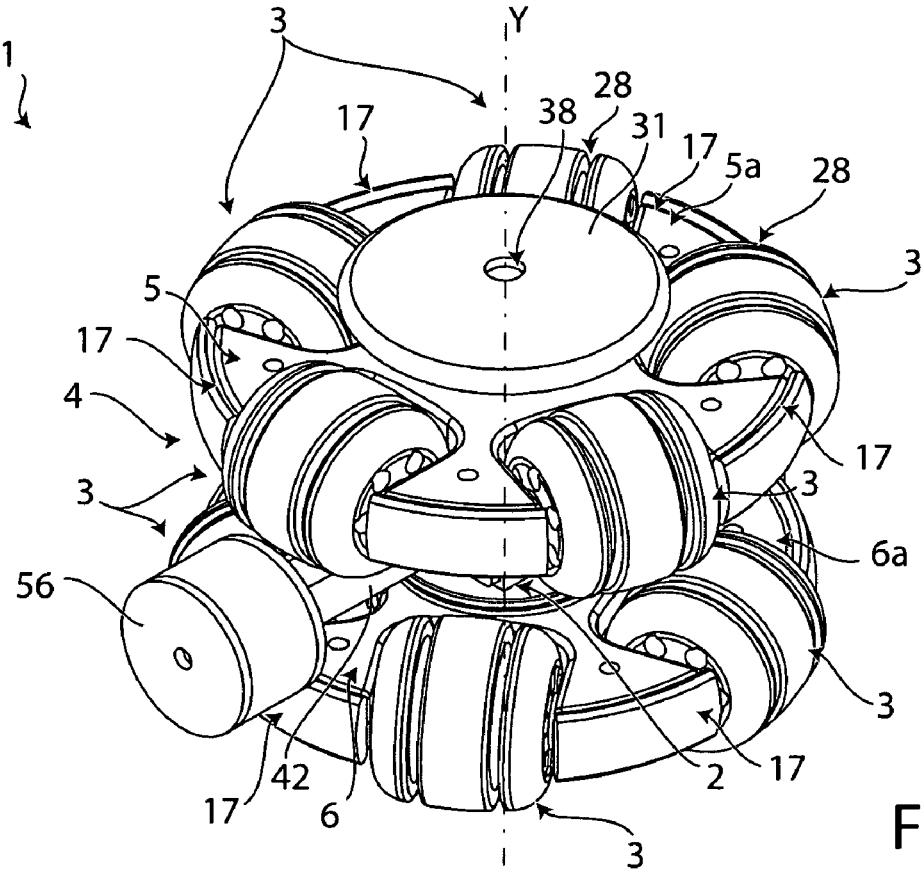
FIG. 1 is a perspective view of the mechanical member according to the invention.
Figure 2:
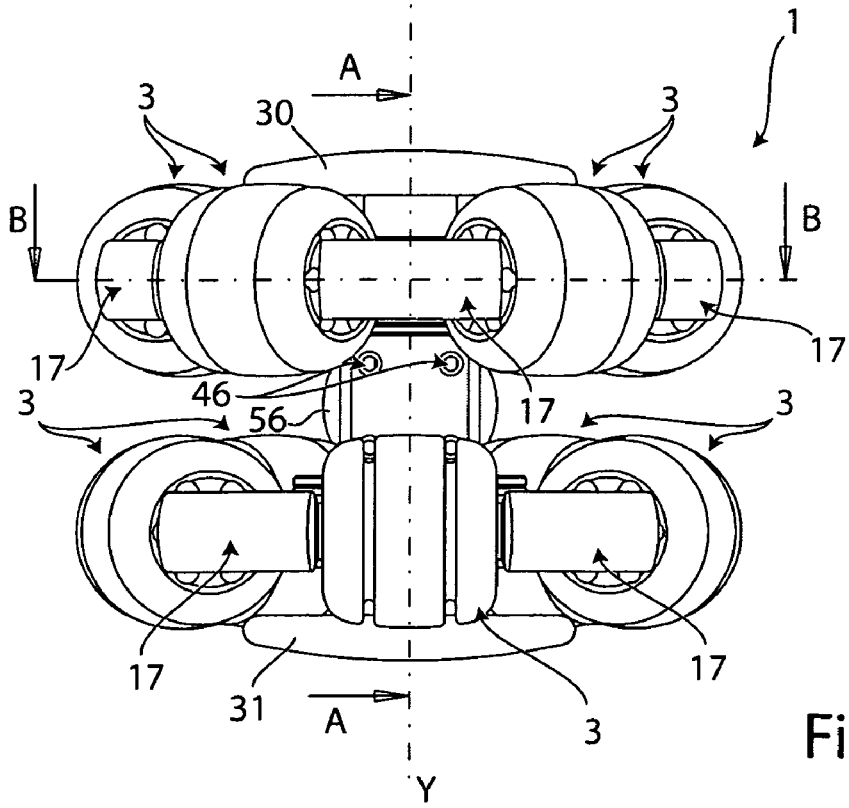
FIG. 2 is a side view of FIG. 1.

The mechanical member, used to facilitate the movement of a means of transport, preferably a boat during mooring, docking or berthing at the port, is shown in FIGS. 1 and 2, where it is generally indicated with 1.

Considering the direction with which the boats typically reach a generic mooring or berthing site, the mechanical member 1 lends itself particularly to be installed on the sides or broadsides of boats in pairs or abaft in pairs.

Figure 3:
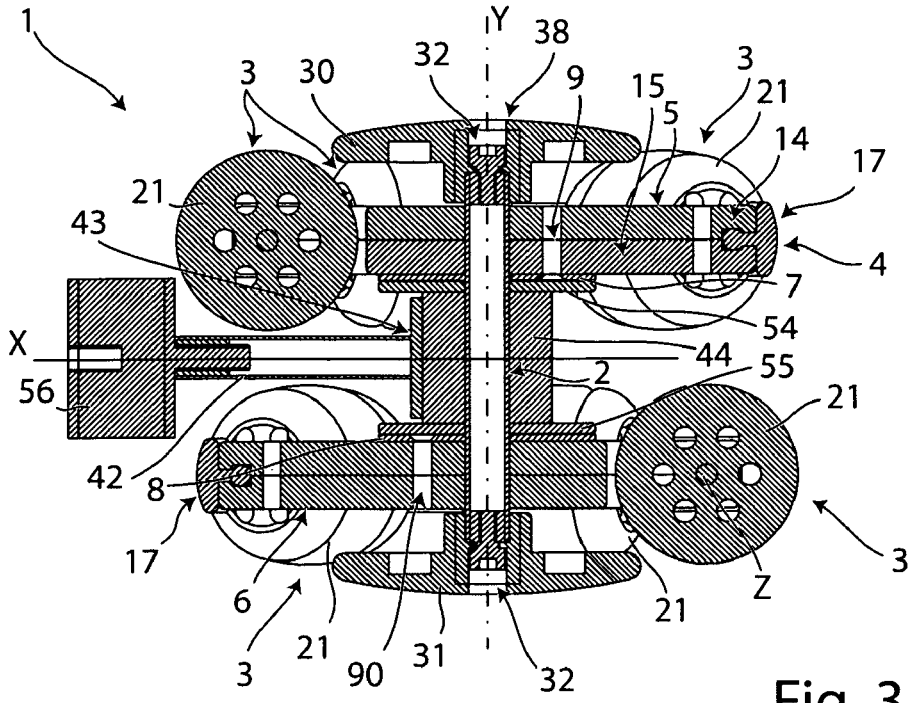
FIG. 3 is the view of FIG. 2 according to the cutting plane A-A.

According to the invention, the mechanical member 1 includes:

- a support shaft 2, clearly visible in FIG. 3, provided with a main axis Y and suitable to be disposed protruding from the means of transport, in this case the boat;
- five sliding bodies 3, connected to the support shaft 2 through union means, as a whole indicated with said five sliding bodies being positioned to come into contact with structures, such as boats already moored at the pier or wharf, to direct the means of transport during the movement in the berthing phase at the port.

Preferably the union means 4 include a pair of shaped discs 5, 6 coupled to the support shaft 2.

Figure 4:
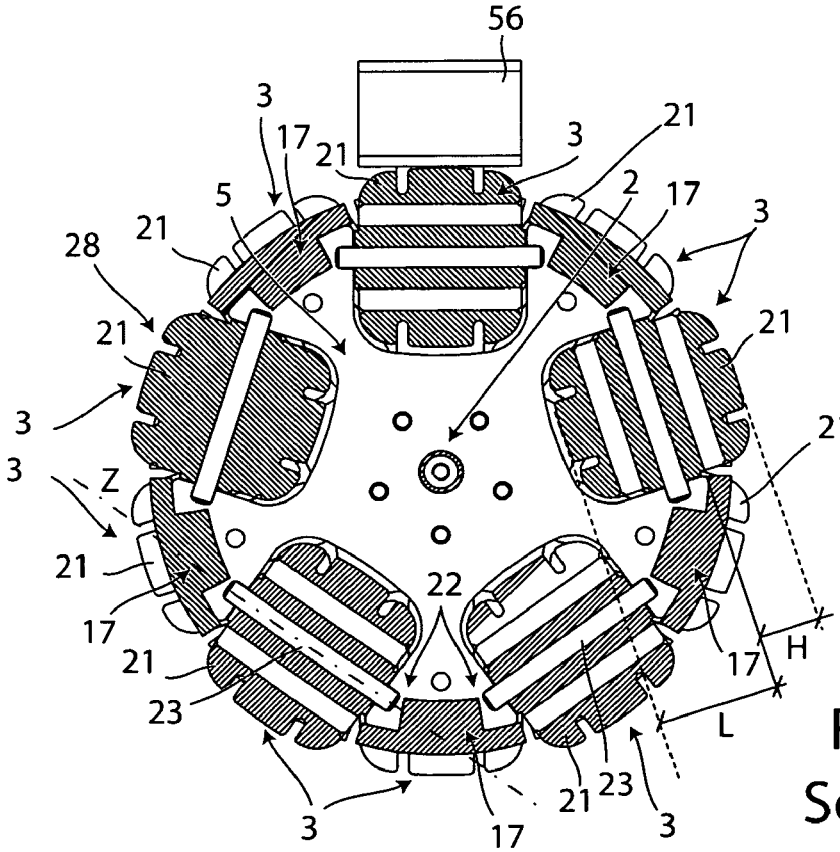
FIG. 4 is the view of FIG. 2 according to the cutting plane B-B.

The sliding bodies 3 are arranged at the perimetric edge 5*a*, 6*a* of the shaped discs 5, 6, from which they protrude for a first stretch H, as shown in FIG. 4.

In addition, the sliding bodies 3 are equally spaced one from each other and uniformly distributed along the perimetric edge 5*a*, 6*a* of the shaped discs 5, 6. The main axis Y of the support shaft 2 advantageously defines for the shaped disks 5, 6 a substantially vertical first axis of rotation.

Figure 5:
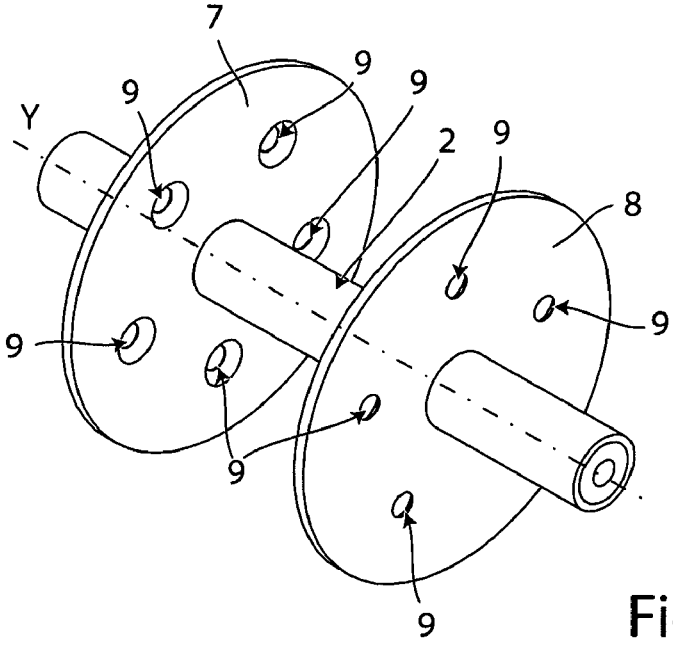
FIG. 5 is the enlarged perspective view of a first particular of FIG. 1.
Figure 6:
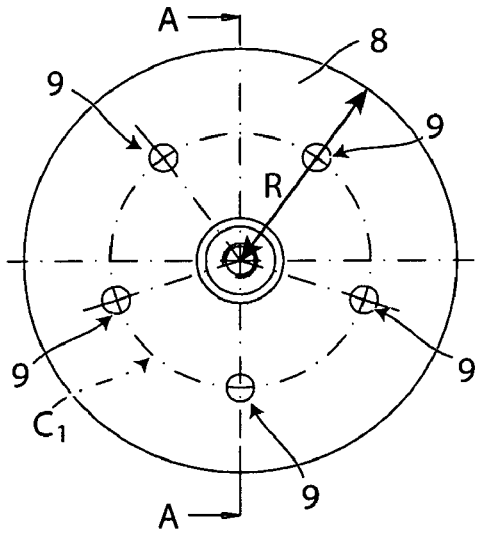
FIG. 6 is a side view of FIG. 5.
Figure 7:
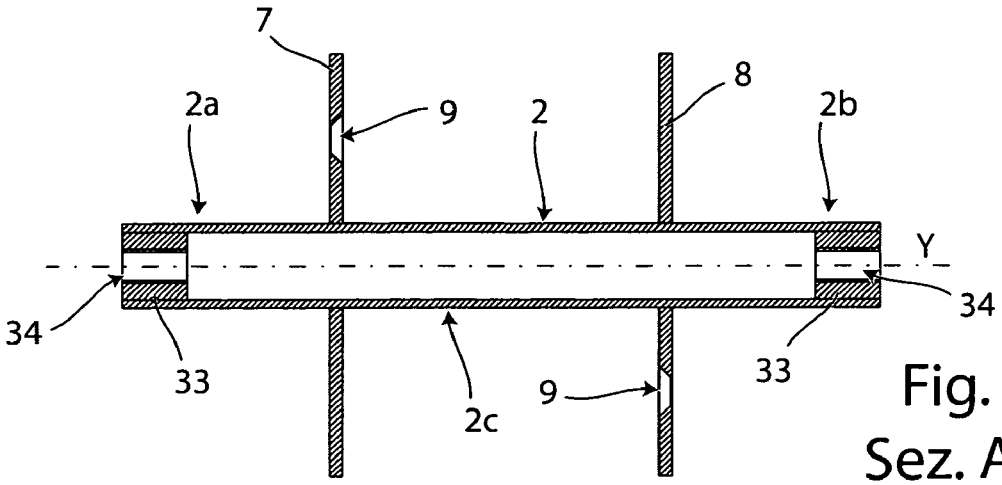
FIG. 7 is the view of figure according to the cutting plane A-A.

As FIG. 3 and, more in detail, FIGS. 5, 6 and 7 illustrate, the support shaft 2, made of metallic material, such as austenitic stainless alloys, is internally hollow and is provided externally with a pair of laminar flanges 7, 8 reciprocally spaced apart, coaxial to the support shaft 2.

In practice, the support shaft 2 is a tubular cylinder to which the laminar flanges 7, 8, having in this case circular shape, are externally and securely coupled.

FIGS. 5, 6 and 7 show that each of the laminar flanges 7, 8 presents a plurality of tapered through holes 9, evenly distributed according to the vertexes of a pentagon along a first circumference $C_1$ substantially placed in the midpoint of the radius R of each of the laminar flanges 7, 8.

The number of laminar flanges 7,8 may also not depend on the length of the support shaft, as shown in an alternative embodiment of the invention.

The shaped discs 5, 6 are respectively arranged between the end 2*a*, 2*b* of the support shaft 2 and one of the laminar flanges 7, 8 to which the shaped discs 5, 6 are firmly connected through first fastening means, indicated with 90 in FIG. 3 and or other types of known fasteners, such as screws, rivets, bolts and the like.

The first fastening means 90 are inserted in the tapered through holes 9 and in holes 10, coaxial to the tapered holes 9 that are formed in the shaped discs 5, 6.

Figure 8:
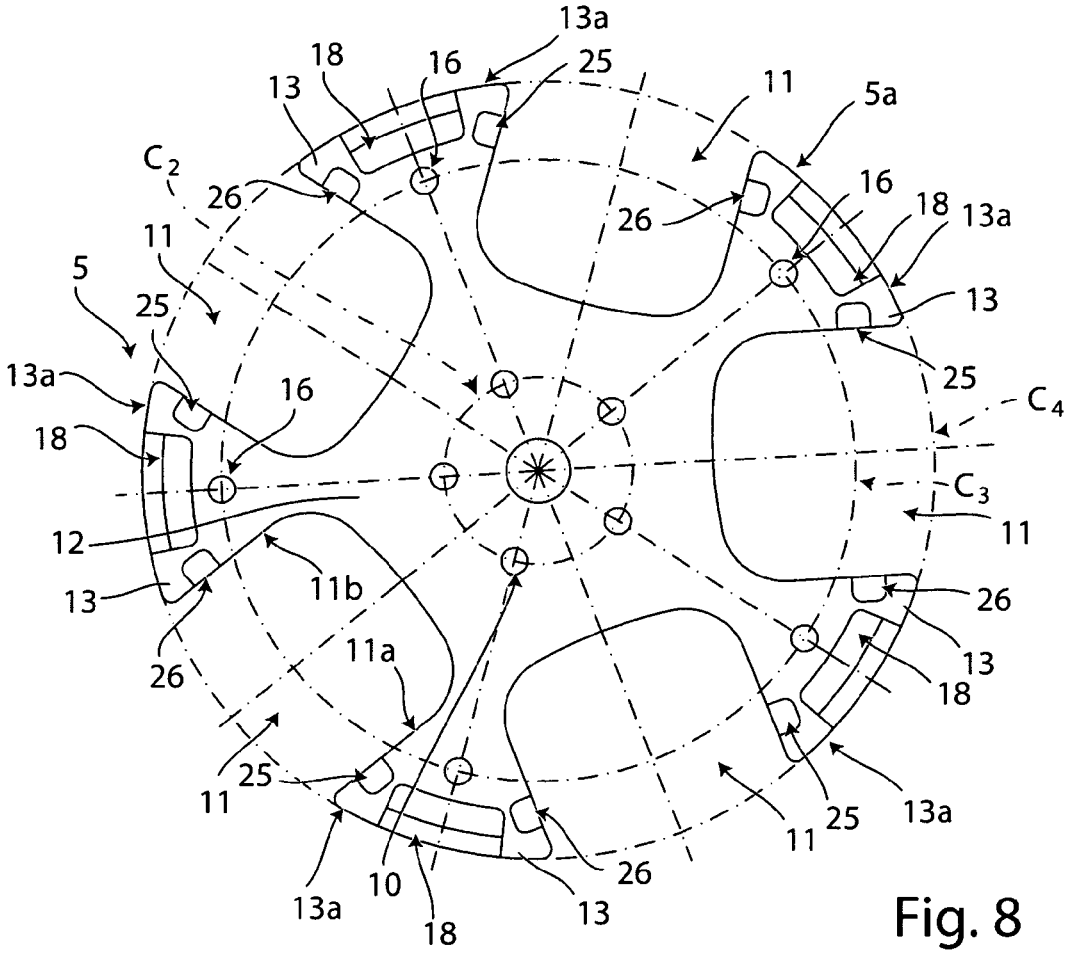
FIG. 8 is an enlarged side view of a second particular of FIG. 1.
Figure 9:
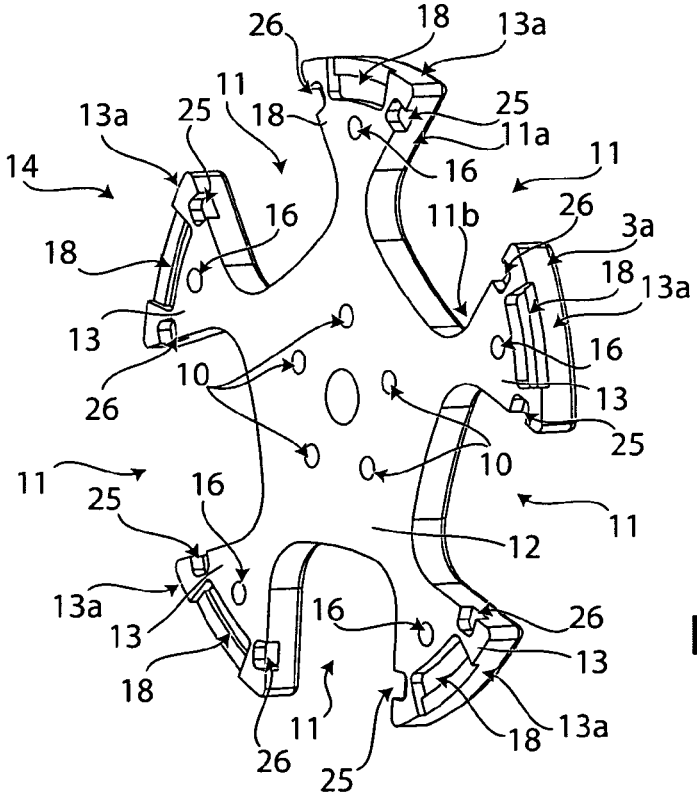
FIG. 9 is a partial and simplified perspective view of FIG. 8.

FIGS. 8 and 9 show that the holes 10 are evenly distributed in the vertexes of a pentagon along a second circumference $C_2$ having radius equal to the radius of the first circumference $C_1$.

Unless otherwise specified, the following description will continue with reference only to the shaped disk 5, meaning that the description for shaped disk 5 also applies to the shaped disk 6.

The shaped disk 5 presents along the perimetric edge 5*a* five radial indentations 11, within each of which one of the sliding bodies 3 is housed for a second stroke L.

Therefore, the number of the sliding bodies 3 is equal to the number of the radial indentations 11.

More generally, in the various forms of the mechanical member of the invention, the number of sliding bodies will always be equal to the number of radial indentations, varying in accordance with the latter.

Preferably, each of the radial indentations 11 presents a substantially U-shaped profile.

The shaped disk 5 presents a profile substantially in the shape of a star, being composed of a central block 12 and five articulated portions 13 equipped with curved outer surfaces 13*a* defining an imaginary outer circumference $C_4$.

The articulated portions 13 project from the central block 12 according to the vertexes of a pentagon and they are spaced out one from each other by the radial indentations 11.

As a matter of fact, FIG. 9 only partially represents the shaped disk 5.

Indeed, as clearly visible in the section of FIG. 3, the shaped disk 5 is in this case formed by two laminar plates 14, 15, congruent to each other, which involves some significant advantages.

The laminar plates 14, 15 are reciprocally connected by using the already mentioned first fastening means, inserted both in the holes 10 and in the further threaded through holes 16 provided in the shaped disk 5.

Also the threaded through holes 16 are uniformly distributed along a third circumference $C_3$, as it is noted in FIG. 9.

Preferably but not necessarily, the laminar plates 14, 15 are made of different materials, in particular one of a metallic material, such as aluminum, the other of polymeric material.

There may exist, however, constructive variations of the invention, not shown, in which the laminar plates 14,15 are made of the same material.

According to the preferred embodiment here described, the mechanical member 1 includes five radial shock absorbers 17, visible in FIGS. 1-4, each of which housed in a peripheral seat 18 provided in each of the outer surfaces 13*a* of the articulated portions 13 of the shaped disc 5.

Figure 10:
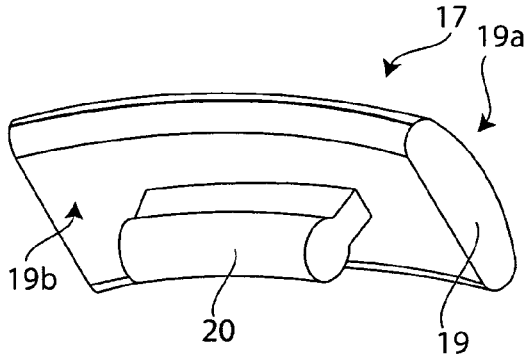
FIG. 10 is an enlarged perspective view of a third particular of FIG. 1.
Figure 11:
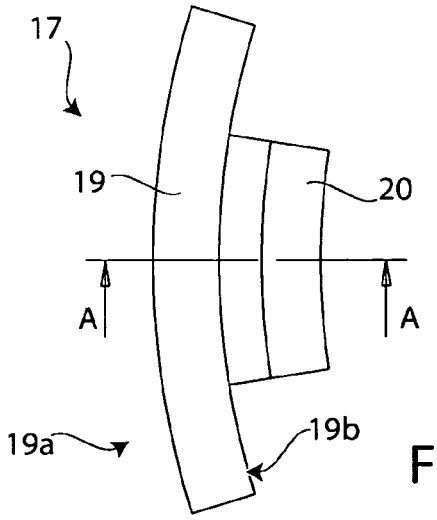
FIG. 11 is a side view of FIG. 10.
Figure 12:
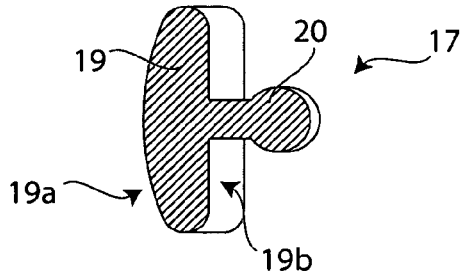
FIG. 12 is the view of FIG. 11 according to the cutting plane A-A.

In FIGS. 10, 11 and 12 it is shown that each of the radial shock absorbers 17, which are real bumpers made of rubber, is composed of:

- an outer cap 19 which has a convex external wall 19*a* and a concave internal wall 19*b* and projects from the perimetric edge 5*a* of the shaped disk 5; and
- a central separator 20, protruding from the internal wall 19*b* of the outer cap 19 where said central separator 20 is inserted in the peripheral seat 18 of the shaped disk 5.

The peripheral seat 18 is, in fact, formed by two equal indentations as shown in FIGS. 8 and 9.

The actual peripheral seat 18 is formed when; as a result of the mutual connection of the two laminar plates 14, 15, the two indentations form peripheral seat 18.

Therefore, the peripheral seat 18 is formed by joining two separate and equal parts that are formed in, the laminar plates 14, 15, formed by molding rather than through a machining of a monolithic piece, made of a single material. However, such a machined monolithic piece is included in the scope of the invention.

As far as the sliding bodies 3 are concerned, each of them includes a revolving roller 21, made of polymeric material, suitable to resist collisions and where said revolving roller 21 defines a second axis of rotation Z. The polymeric material includes any of the materials selected from the group consisting of nylon, polyoxymethylene, polyethylene and the like.

The revolving roller 21 is coupled to the shaped disk 5 through restraint means, as a whole numbered with 22 in FIG. 4.

Figure 13:
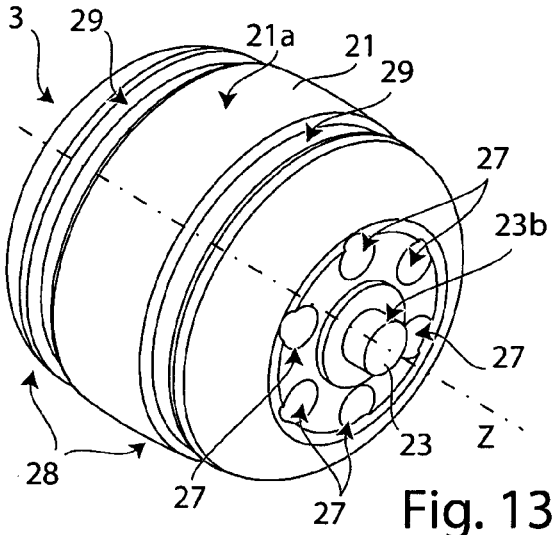
FIG. 13 is an enlarged perspective view of a quarter particular of FIG. 1.
Figure 14:
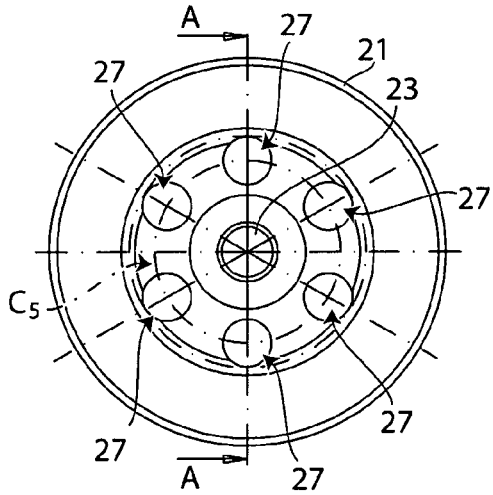
FIG. 14 is a side view of FIG. 13.
Figure 15:
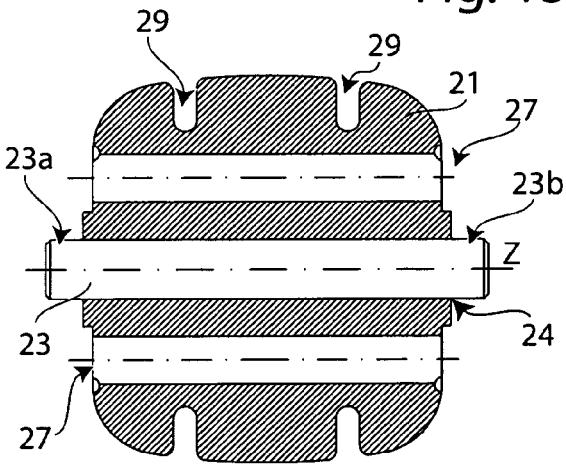
FIG. 15 is the view of FIG. 14 according to the cutting plane A-A.

The restraint means 22 include a pin 23 inserted in an axial through hole 24 made in the revolving roller 21, as can be seen in FIGS. 13-15.

The ends 23*a*, 23*b* of the pin 23 are housed in internal cavities 25, 26 provided on the side walls 11*a*, 11*b* one opposed to the other bounding each of the radial indentations 11, as best seen in FIGS. 8 and 9.

What has been said in relation to the formation of the peripheral seat 18 also applies to the internal cavities 25, 26, each of which being composed of a first half obtained in the laminar plate 14 and a second half obtained in the laminar plate 15.

Each revolving roller 21 also presents a series of through holes 27, which develop parallel to the axis of rotation of the axial hole 24, around which they are arranged uniformly along an imaginary inner circumference $C_5$.

Such through holes 27 have the function of lightening the revolving roller 21 and the mechanical member 1.

The lateral surface 21*a* of the revolving roller 21 presents sliding means 28, reduce the rolling friction between the revolving roller 21 and the adjacent structures with which it comes in contact. In practice, the sliding means 28 increases the rolling ability of the revolving roller 21 and avoids scraping against adjacent structures by the means of transport and damaging said adjacent structures.

The presence of the sliding means 28 facilitates, for example, the release or discharge from the revolving roller 21 of foreign objects or anything else which, in certain cases, would stick to its lateral surface 21*a* and would as a result limit its rotation.

The sliding means 28 preferably but not exclusively includes two annular grooves 29 which, in other embodiments of the invention not shown in the appended drawings, can be of any number starting from one or may be replaced by one or more knurled areas.

In the initial FIGS. 1-3 it is also observed that the mechanical member 1 comprises a pair of axial shock absorbers 30, 31, each coupled to one end 2*a*, 2*b* of the support shaft 2 by second fastening means, indicated by reference character 32.

Figure 16:
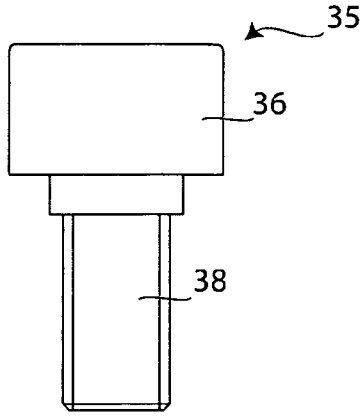
FIG. 16 is an enlarged side view of a fifth particular of FIG. 1.

In a preferred but not restricted way, the second fastening means 32 is:

- a sleeve 33, also visible in FIG. 7, placed within the end 2*a*, 2*b* of the support shaft 2 and having a threaded central opening 34;
- a screw 35, better shown in FIG. 16, provided with a head 36, positioned within an axial housing 37 provided in each of the axial shock absorbers 30, 31 and coaxial to the central opening 34, and with a threaded shank 38 which engages into the central opening 34.

Figure 17:
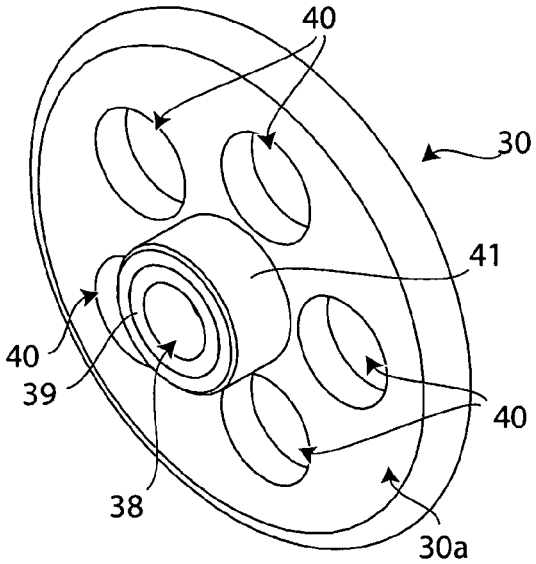
FIG. 17 is an enlarged perspective view of a sixth particular of FIG. 1.
Figure 18:
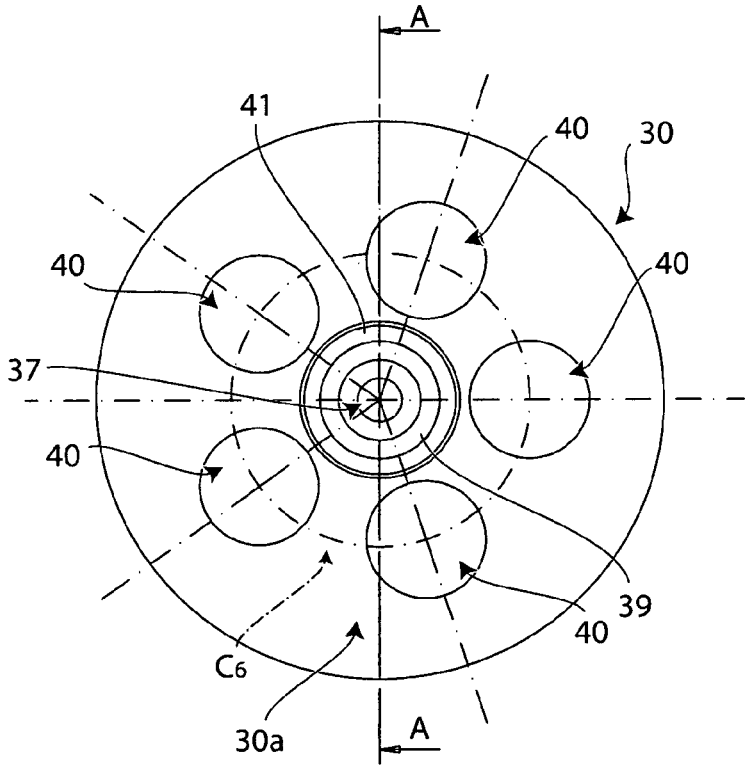
FIG. 18 is a side view of FIG. 17.
Figure 19:
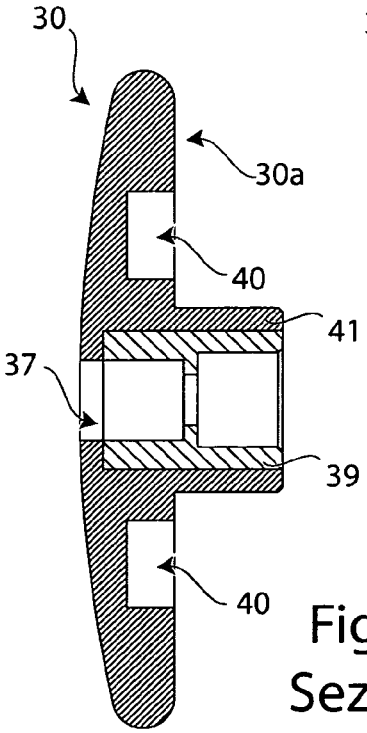
FIG. 19 is the view of FIG. 18 according to the cutting plane A-A.
Figure 20:
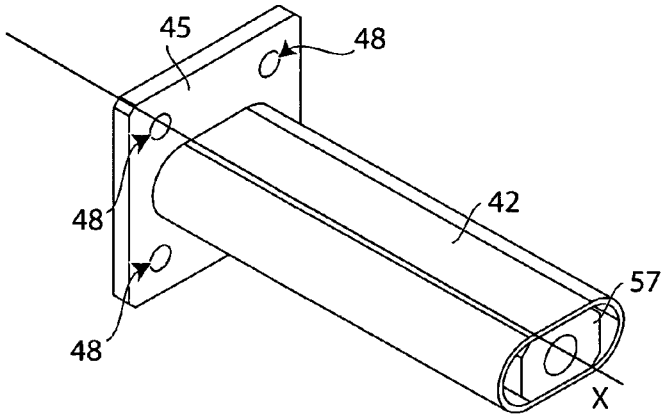
FIG. 20 is a perspective view of a seventh enlarged particular of FIG. 1.
Figure 21:
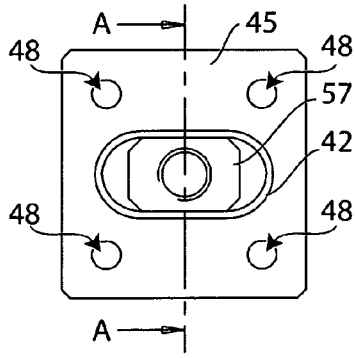
FIG. 21 is a side view of FIG. 20.
Figure 22:
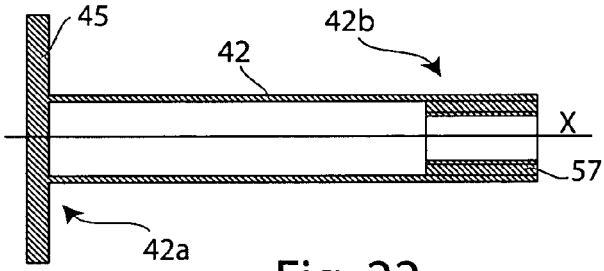
FIG. 22 is the view of FIG. 21 according to the cutting plane A-A.
Figure 23:
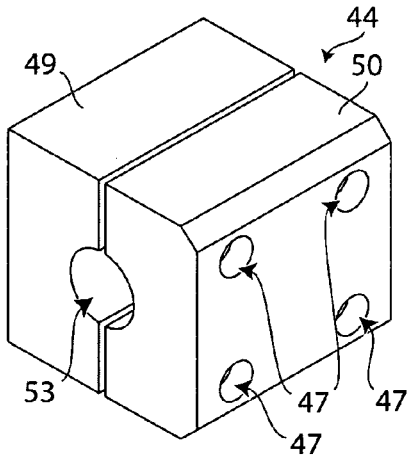
FIG. 23 is an enlarged perspective view of an eighth particular of FIG. 1.
Figure 24:
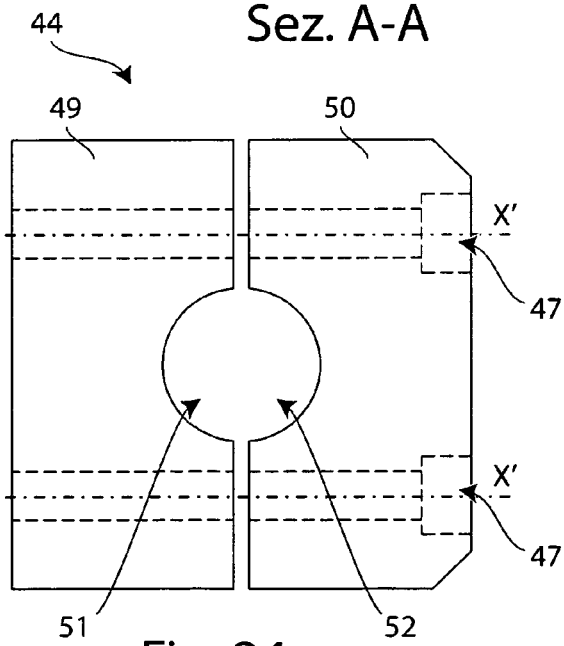
FIG. 24 is the side view of FIG. 23.
Figure 25:
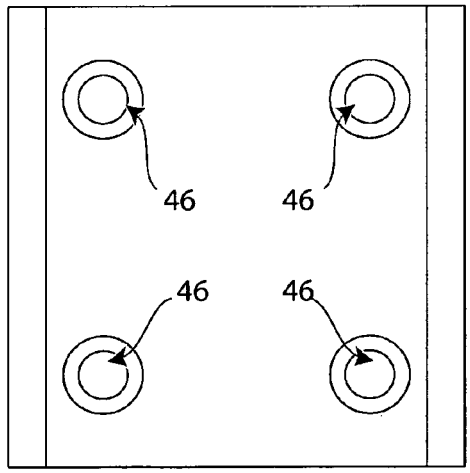
FIG. 25 is the front view of FIG. 23.
Figure 27:
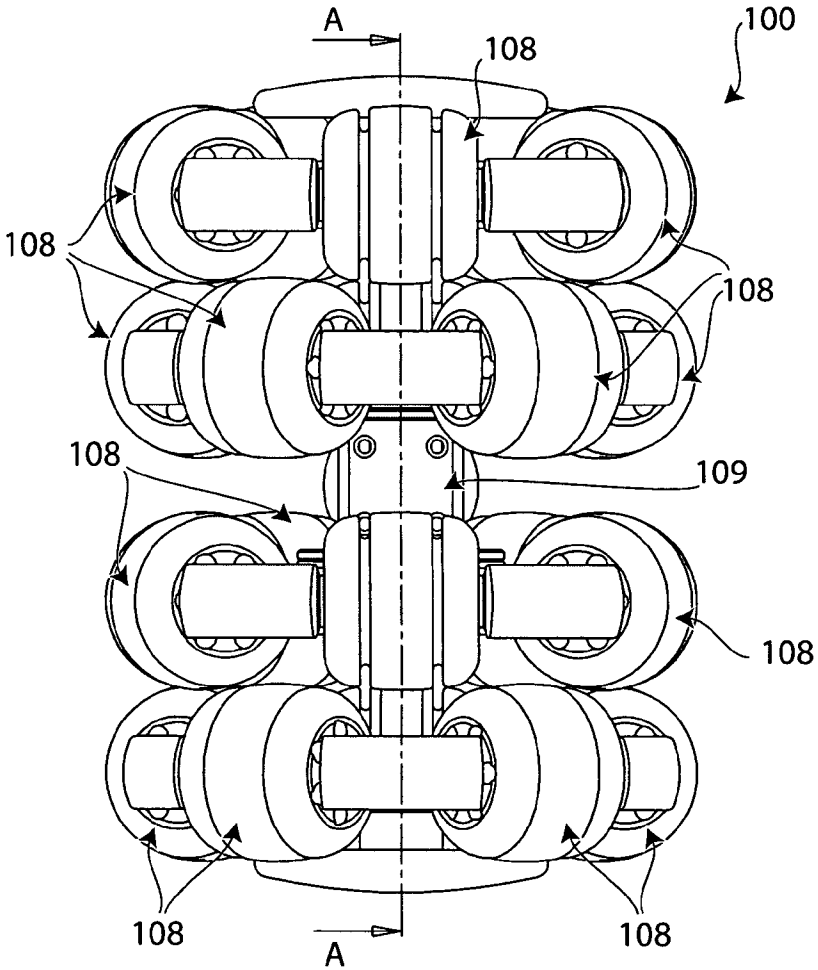
FIG. 27 is a side view of FIG. 26.
Figure 26:
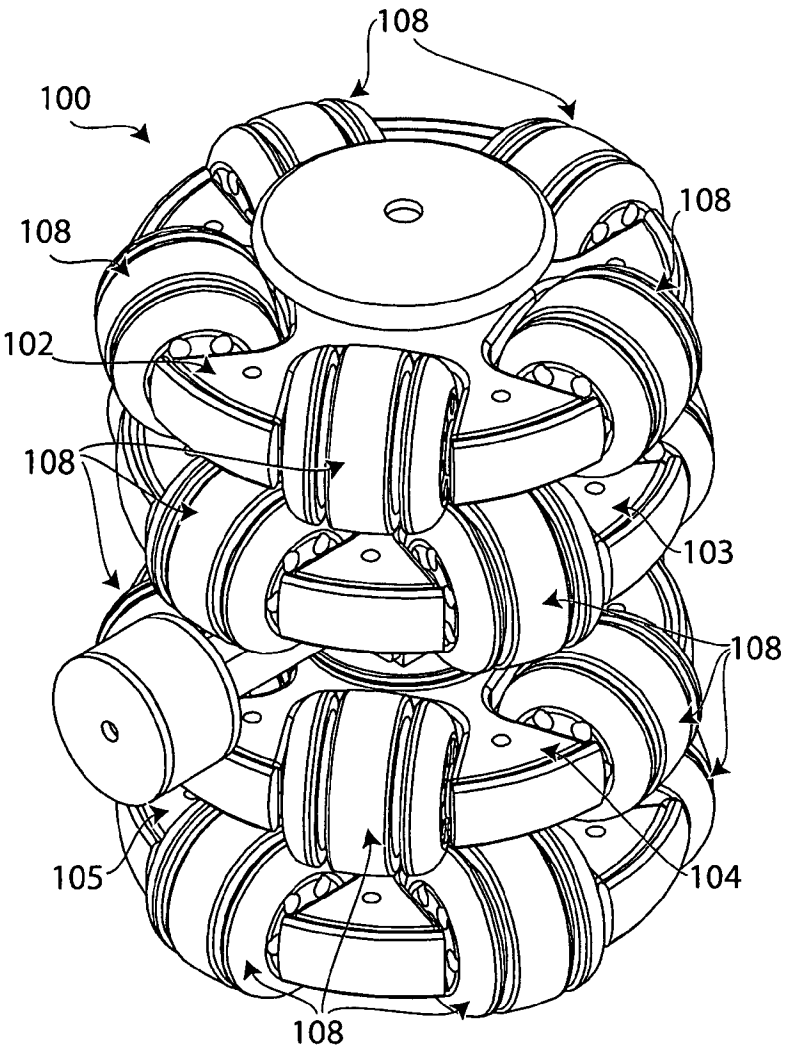
FIG. 26 is a first different embodiment of FIG. 1.

FIGS. 17-19 show that the axial shock absorber 30 includes a tubular insert 39 inserted into the axial housing 37 and interposed between this and the screw 35 to accommodate inside the head 36 of the screw 35 itself, said head 36 being for example a socket head screw.

Therefore, the axial shock absorber 30 has a composite structure in which a rigid central inside contrasts with an outer flexible and elastic zone: such a structure makes it particularly for absorbing the accidental collisions without suffering clear pliability or deformations.

Moreover, the axial shock absorber 30 presents an flat inner wall 30*a* where a series of peripheral recesses 40 are provided for reducing the weight of the shock absorber 30. These peripheral recesses are arranged along circumference $C_6$ around a central stem 41 projecting from the inner wall 30*a*.

In cross section, the axial shock absorber 30, made of rubber, presents a substantially mushroom-shaped profile while the tubular insert 39, that is made of brass, has a substantially H-shaped profile.

Again FIGS. 1-4 illustrate that the mechanical member 1 comprises a support arm 42 for mounting on a supporting structure, not shown.

The support arm 42 mainly develops along a longitudinal direction X substantially orthogonal to the main axis Y.

The support arm 42 is coupled to the support shaft 2 by means of a connection, on the whole indicated with 43 in FIG. 3.

The connection means 43, shown in detail in FIGS. 20-25, include:

- a shaped clamp 44, made for example of polytetrafluoroethylene (PTFE, also known as Teflon®), locked outside the middle zone 2*c* of the support shaft 2;
- a laminar bracket 45 interposed between the support arm 42 and the shaped clamp 44;
- a series of screws 46 inserted through openings 47, 48 that are coaxial to one other and are provided in the shaped clamp 44 and in the laminar bracket 45.

The shaped clamp 44 is composed of two parallelepiped blocks 49, 50 one opposed and side by side to the other, in each of which a semi-circular cavity 51, 52 is provided which forms a central through hole 53 in which the middle zone 2*c* of the support shaft 2 is received when the parallelepiped blocks 49, 50 are coupled one to another by means of the screws 46.

The through openings 47, 48 define longitudinal axis X' which is substantially orthogonal to the main axis Y of the support shaft 2 and to the longitudinal axis of the central hole 53.

It is further observed that the laminar bracket 45 protrudes from a first end 42*a* of the support arm 42, in a plane which is perpendicularly intersected by the longitudinal direction X of the support arm 42.

In particular, the support arm 42 consists of a tubular sheet which makes it partly flexible and useable with a further shock absorber element which offers to the mechanical member 1 the ability to move on another axis. Between the shaped clamp 44 and each of the laminar flanges 6, 7 affixed to the support shaft 2 is interposed a spacer washer 54, 55, having a circular shape. The spacer washer 54, 55 is made for example of nylon, arranged externally coaxial to the support shaft 2.

Finally, the mechanical member 1 includes a vibration-damping element 56, made of plastic material, for example rubber or polyvinylchloride (PVC).

The vibration-damping element 56 is applied to the second end 42*b* of the support arm 42 and is suitable to be coupled to a generic supporting structure, already mentioned, through the use of a threaded sleeve 57 inserted in said second end 42*b*.

The following figures show another embodiment of the invention where the mechanical member, now globally numbered 100, differs from the one previously described simply in that it comprises a higher number of shaped disks coupled to the support arm 101, in this case four disks numbered 102, 103, 104, 105.

Figure 28:
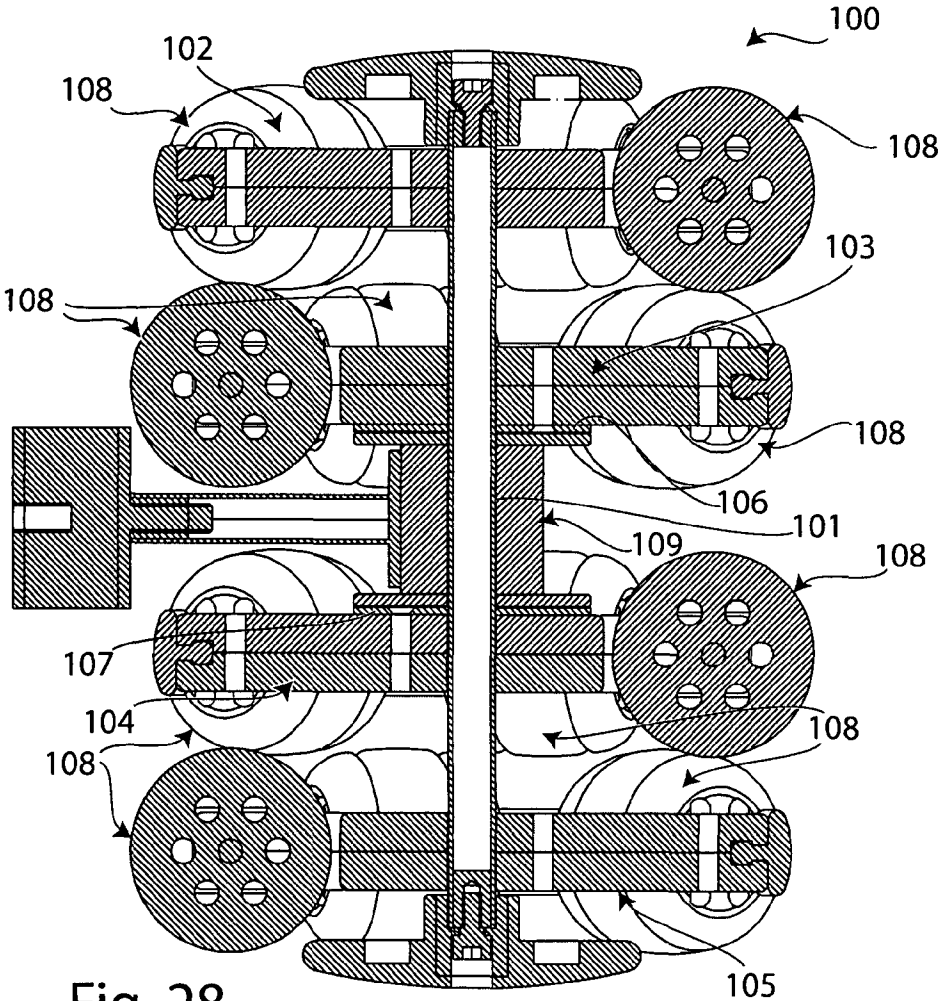
FIG. 28 is the view of FIG. 27 according to the cutting plane A-A.

Only two laminar flanges 106, 107, are mounted on the support shaft 101, between the top pair of shaped disks 102, 103 and the lower pair of shaped disks 104, 105 as shown in FIG. 28.

In such an arrangement the sliding bodies 108 on shaped disks 102, 103 slide over one another in the same manner that the sliding bodies 108 of the shaped disks 104, 105 slide over one another, while the shaped disks 103 and 104 are spaced apart from one another by the shaped clamp 109.

The mechanical member 100 of the invention is particularly useful for larger means of transport, such as for example boats around 100-140 feet, while the mechanical member 1 previously described is suitable for boats of smaller dimensions, such as 30/40 feet.

In any case, the mechanical member of the invention in the versions here described may be used on several boats which differ in size, and have lengths in the range from 30 to 140 feet.

Figure 29:
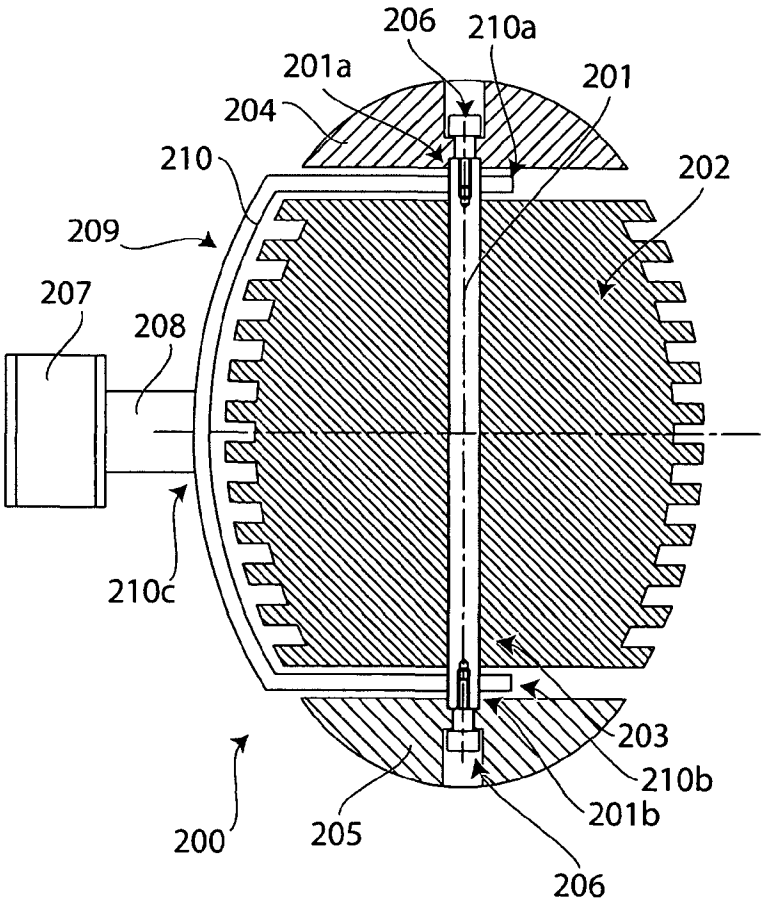
FIG. 29 is a cross section view of a second different embodiment of FIG. 1.

FIG. 29 shows another embodiment of the invention in which the mechanical member 200, differs from the previous embodiments in that it includes only one sliding body 202, and union or connector means 203, as a whole numbered with 203, through which such sliding body 202 is connected to the support shaft 201.

It is noted that the support shaft 201 is not internally hollow, as before, but consists essentially of a linear bar.

In this regard, the union or connector means 203 include in this case a central through hole, not shown, made axially in the sliding body 202, and the same support shaft 201 inserted in such a central hole and provided with ends 201*a*, 201*b* projecting from the sliding body 202. Also in this example, the axial shock absorbers 204, 205 are coupled to the ends 201*a*, 201*b* of the support shaft 201 through second fastening means 206.

Preferably, however, the axial shock absorbers 204, 205, made of rubber, have here a profile in the shape of a hemispheric cap.

Another substantial difference of the mechanical member 200 with respect to the mechanical members 1, 100 relates to the means of connection 209, by which the vibration-damping element 207 is connected to the support shaft 201.

The support arm 208, which consists of a tubular sheet and to which the vibration-damping element 207 is fixed, is no longer coupled to a shaped clamp, as in the previous embodiments, but to a side support 210 which is C shaped in cross section.

The side support 210 is provided with ends 210*a*, 210*b* associated to the support shaft 201 and with a central part 210*c* associated to the support arm 208.

In use, one or more mechanical members 1, 100, 200, the number depending on the size of the means of transport, are arranged protruding laterally from the means of transport itself while the means of transport moves to a stop area for docking.

In the case of boats, the mechanical member 1, 100, 200 is typically arranged protruding from the sides and the stern during mooring or docking at the pier or wharf.

At that stage, the driver conveniently moves to reverse the means of transport to dock at the stop area: in case of a boat, this means that the boat firstly accesses the stop area with the stern. Such a maneuver has been particularly risky and difficult in the prior art, is now facilitated by the mechanical member 1 which, in fact, is disposed close to the other means of transport that are stopped or to any structures present in the area, without causing any damage.

The smooth outer surface of the rotating roller 21, has its rotation around the second axis Z, the rotation of the shaped disk 5, 6 around the main axis Y of the support shaft 2, as well as the flexing ability of the support arm 42 provides a safety contact between the mechanical member 1 and the surrounding structures or bodies.

Therefore, the mechanical member 1 allows the mounted means of transport to adjust themselves, during the movement, to the other adjacent means of transport or bodies and to occupy the space allotted to it in an easy, fast and safe manner.

Indeed, the mechanical member 1 frees itself from such bodies in an almost instantaneous and natural way, limiting to a minimum the movement of the parts in mutual contact.

Moreover, in a collision with structures, or other near bodies, the shape and the composition of the mechanical member 1 allows it to keep working unlike other systems that will not continue to function.

At the end of the maneuver to access the stop area, the mechanical member 1 is removed from the sides of the means of transport.

For example, when the boat is completely stopped, the mechanical member 1 removed from the sides and stern is replaced by the common protection systems, such as fenders.

Then, the mechanical member of the invention, for example in the alternative embodiments 1, 100, 200 described, allows the driver to perform the moving of the means of transport in absolute safety without damaging the structural integrity of the means of transport, as well as of other means of transport or similar structures which are disposed in its vicinity.

The maneuvering of the means of transport by the driver, especially when a boat is berthing to a stop area such as the pier or the wharf of a port facilitated and requires less time to be efficiently and correctly completed.

By virtue of the above, it is understood, therefore, that the mechanical member of the invention for facilitating the movement of a means of transport, is especially suitable for boats, and achieves the aims and provides the advantages already mentioned.

Modifications of the mechanical member of the invention may consist, for example, in a number and in a form of the shaped disks that differ from those described and illustrated above.

In addition, other versions of the invention can exist in which the mechanical member includes a number of sliding bodies different from the one indicated which may vary.

The main axis defined by the support shaft can be also oriented according to a direction different from those described in the previous examples, which does not affect the advantage underlying the present invention.

In addition, the mechanical member could include detection and/or signal means, such as position sensors, which may signal to the driver the touch of the mechanical member with other bodies during the movement of the means of transport on which the member is mounted.

It is clear, then, that many other variations can be made to the mechanical member in question, without departing from the novelty inherent in the inventive concept disclosed in the practical implementation of the invention, using any appropriate materials, shapes and sizes depending on the needs.

The invention claimed is:

1. A mechanical boat fender (1; 100; 200) for facilitating the movement of a boat where said mechanical boat fender comprises a support shaft (2; 101; 201) provided with a main axis (Y) connected to a support arm (42) said mechanical boat fender being connected to said support shaft (2; 101;201) through star shaped disks (5; 6; 102; 103; 104; 105) for mounting radially arranged shock absorbers 17 at an end of said star shaped disks (5;6;102;103;104; 105) and a plurality of sliding bodies (3; 108; 202) placed at a perimetric edge (5*a*; 6*a*) of said star shaped disks (5; 6; 102; 103; 104;105) wherein said star shaped disks 5; 6; 102; 104; 105) extend from said support shaft (2;101;201) to support said plurality of sliding bodies (3; 108;202) said mechanical boat fender being adapted to mitigate the effects of collisions between a boat and other structures.

2. A mechanical boat fender (1; 100) as defined in claim 1 wherein said sliding bodies (3; 108) are equally spaced one from the other and uniformly distributed along said perimetric edge (5*a*, 6*a*) of said star shaped disk (5, 6; 102, 103, 104, 105).

3. A mechanical boat fender (1; 100) as defined in any of claims 1 or 2 wherein said main axis (Y) of said support shaft (2; 101) defines a first axis of rotation for said star shaped disk (5, 6; 102, 103, 104, 105).

4. A mechanical boat fender (1; 100) as defined in claim 1 wherein said support shaft (2; 101) is internally hollow and is externally provided with at least one flange (7, 8; 106, 107) coaxial to said support shaft (2; 101).

5. A mechanical boat fender (1; 100) as defined in claim 4 wherein said star shaped disk 6; 102, 103, 104, 105) has along said perimetric edge (5*a*, 6*a*) one or more radial indentations (11) within each of which one of said sliding bodies (3; 108) is housed for a second stroke (L).

6. A mechanical boat fender (1; 100) as defined in claim 5 wherein said star shaped disk (5, 6; 102, 103, 104, 105) presents a profile substantially in the shape of a star, said star shaped disk being composed of a central block (12) and a plurality of articulated portions (13) equipped with curved outer surfaces (13*a*) which define an imaginary outer circumference ($C_4$), projecting from said central block (12) according to the vertexes of a pentagon and being spaced out one from each other by said radial indentations (11).

7. A mechanical boat fender (1; 100) as defined in claim 5 wherein each of said radial indentations (11) has a substantially U-shaped profile.

8. A mechanical boat fender (1; 100) as defined in claim 4 wherein said star shaped disk (5, 6; 102, 103, 104, 105) is arranged between an end (2*a*, 2*b*) of said support shaft (2; 101) and said laminar flange (7, 8; 106, 107) is connected to said support shaft (2,101) by first fastening means (90).

9. A mechanical boat fender (1; 100) as defined in claim 8 wherein said first fastening means (90) include screws inserted in female screws (10, 16) obtained in said star shaped disk 5, 6; 102, 103, 104, 105), and in tapered through holes (9) provided in said flange (7, 8; 106, 107).

10. A mechanical boat fender (1; 100) as defined in claim 6 wherein it includes a plurality of radial shock absorbers (17), each housed in a peripheral seat (18) provided in each of said outer surfaces (13*a*) of said articulated portions (13) of said star shaped disk 5,6; 102, 103, 104, 105).

11. A mechanical boat fender (1; 100) as defined in claim 10 wherein each of said radial shock absorbers (17), made of rubber, is composed of: an outer cap (19), which has a convex external wall (19*a*) and a concave internal wall (19*b*) and projects from said perimetric edge (5*a*, 6*a*) of said star shaped disk (5, 6; 102, 103, 104, 105); a central separator (20), protruding from said internal wall (19*b*) of said outer cap (19), inserted in said peripheral seat (18) of said star shaped disk (5, 6; 102, 103, 104, 105).

12. A mechanical boat tender (1; 100) as defined in claim 1 wherein said star shaped disk (5, 6; 102, 103, 104, 105) is formed by two plates (14, 15), congruent one with each other, reciprocally connected through said first fastening means (90).

13. A mechanical boat fender (1; 100) as defined in claim 1 wherein said sliding body (3; 108) comprises a revolving roller (21) made of polymeric material, suitable to resist collisions and to define a second rotation axis (Z).

14. A mechanical boat fender (1; 100) as defined in claim 13 wherein said polymeric material includes any of the materials selected from the group consisting of nylon, polyoxymethylene, and polyethylene.

15. A mechanical boat fender (1; 100) as defined in claim 13 wherein said rotating roller (21) is coupled to said star shaped disk (5, 6; 102, 103, 104, 105) through restraint means (22).

16. A mechanical boat fender (1; 100) as defined in claim 15 wherein said restraint means (22) include a pin (23) inserted in an axial through hole (24) made in said revolving roller (21), the ends (23*a*, 23*b*) of said pin (23) being housed in internal cavities (25, 26) provided on the side walls (11*a*, 11*b*) one opposed to the other bounding each of said radial indentations (11).

17. A mechanical boat fender (1; 100) as defined in claim 13 wherein said rotating roller (21) has a plurality of through holes (27), which develop parallel to said rotation axis (Z) of said axial hole (24), said holes uniformly arranged around said axial hole (24) along an imaginary inner circumference ($C_5$).

18. A mechanical boat fender (1; 100) as defined in claim 13 wherein said rotating roller (21) presents on the lateral surface (21*a*) sliding means (28) suitable to facilitate the rolling friction between said revolving roller (21) and said adjacent structures that it contacts.

19. A mechanical boat fender (1; 100) as defined in claim 18 wherein said sliding means (28) include one or more annular grooves (29), or one or more knurled zones.

20. A mechanical boat fender (1; 100; 200) as defined in claim 1 which comprises a pair of axial shock absorbers (30, 31; 204, 205), each; 201) through second fastening means (32; 206), coupled to one end (2*a*, 2*b*) of said support shaft (2; 101; 201;) through second fastening means (32; 206).

21. A mechanical boat fender (1; 100) as defined in claim 20 wherein said second fastening means (32) include: a sleeve (33) placed within said end (2*a*, 2*b*) of said support shaft (2; 101) and having a threaded central opening (34); a screw (35) provided with a maneuver head (36), positioned within an axial housing (37) provided in each of said axial shock absorbers (30, 31) and coaxial to said central opening (34), and with a threaded shank (38) which engages into said central opening (34).

22. A mechanical boat fender (1; 100) as defined in claim 21 wherein each of said axial shock absorbers (30, 31) includes a tubular insert (39), inserted into said axial housing (37), interposed between said axial housing (37) and said screw (35) to accommodate said maneuver head (36) of said screw (35).

23. A mechanical boat fender (1; 100) as defined in claim 22 wherein, in cross section, each of said axial shock absorbers (30, 31), is made of rubber, presents a substantially mushroom shaped profile and said tubular insert (39), made of brass, a substantially H shaped profile.

24. A mechanical boat fender (200) as defined in claim 20 wherein each of said axial shock absorbers (204, 205), made of rubber, presents a profile substantially in the shape of a hemispheric cap in cross section.

25. A mechanical boat fender (1; 100) as defined in claim 20 wherein each of said axial shock absorbers (30, 31) presents a flat inner wall (30*a*) having a series of peripheral recesses (40), suitable to lighten each of said axial shock absorbers (30, 31) and arranged along an imaginary circumference ($C_6$) around a central stem (41) projecting from said inner wall (30*a*).

26. A mechanical boat fender (1; 100; 200) as defined in claim 4 which includes a support arm (42; 208) for the application to a supporting structure, which develops along a longitudinal direction (X) substantially orthogonal to said main axis (Y) and is coupled to said support shaft (2; 101; 201) by means of a connection (43; 209).

27. A mechanical boat fender (1; 100) as defined in claim 26 wherein said means of connection (43) include: a shaped clamp (44; 109) locked outside a middle zone (2*c*) of said support shaft (2; 101); a laminar bracket (45) interposed between said support shaft (2; 101) and said shaped clamp (44; 109); at least one screw (46) inserted into through openings (47, 48), one coaxial to the other, obtained in said shaped clamp (44; 109) and in said laminar bracket (45).

28. A mechanical boat fender (1; 100) as defined in claim 27 wherein said shaped clamp (44; 109) consists of two parallelepiped blocks (49, 50), one opposed and one side by side to the other, in each of which a semi-circular cavity (51, 52) is provided which engages said shaped clamp (44; 109) a central through hole (53) where said middle zone (2*c*) of said support shaft (2; 101) is received when said parallelepiped blocks (49, 50) are coupled one to another through said screw (46).

29. A mechanical boat fender (1; 100) as defined in claim 28 wherein said through openings (47, 48) define a longitudinal axis (X') substantially orthogonal to said main axis (Y) of said support shaft (2; 101) and to the longitudinal axis of said central hole (53).

30. A mechanical boat fender (1; 100) as defined in claim 27 wherein said laminar bracket (45) protrudes from a first end (42*a*) of said support arm (42), defining a plane which is perpendicularly intersected by said longitudinal direction (X) of said support arm (42).

31. A mechanical boat fender (1; 100; 200) as defined in claim 26 wherein said support arm (42; 208) consists of a tubular sheet designed to make it partially flexible.

32. A mechanical boat fender (1; 100) as defined in claim 27 which includes a spacer washer (54) interposed between said laminar flange (6, 7; 106, 107) and said shaped clamp (44; 109), arranged externally coaxial to said support shaft (2; 101).

33. A mechanical boat fender (200) as defined in claim 26 wherein said means of connection (209) include a C-conformed side support (210), provided with ends (210*a*, 210*b*) associated to said support shaft (201) and with a central part (210*c*) associated to said support arm (208).

34. A mechanical boat fender (1; 100; 200) as defined in claim 27 which comprises a vibration-damping element (55; 207), made of plastic material and applied to a second end (42*b*) of said support arm (42; 208), that is suitable to be coupled to said supporting structure.

* * * * *